United States Patent [19]

Lorenz

[11] Patent Number: 4,951,491

[45] Date of Patent: Aug. 28, 1990

[54] APPARATUS AND METHOD FOR SUPERPLASTIC FORMING

[75] Inventor: Roy H. Lorenz, Rancho Palos Verdes, Calif.

[73] Assignee: Rockwell International Corporation, El Segundo, Calif.

[21] Appl. No.: 428,677

[22] Filed: Oct. 30, 1989

[51] Int. Cl.[5] ..... B21D 26/02

[52] U.S. Cl. ..... 72/60; 72/38; 72/56; 72/709; 29/421.1

[58] Field of Search ..... 72/38, 54, 56, 57, 60, 72/63, 364, 709; 29/421.1

[56] References Cited

U.S. PATENT DOCUMENTS

| | | | |
|---|---|---|---|
| 3,934,441 | 1/1976 | Hamilton et al. | 72/60 |
| 4,288,021 | 9/1981 | Leodolter | 29/421.1 |
| 4,352,280 | 10/1982 | Ghosh | 72/60 |
| 4,354,369 | 10/1982 | Hamilton | 72/60 |
| 4,516,419 | 5/1985 | Agrawal | 72/60 |
| 4,708,008 | 11/1987 | Yasui et al. | 72/709 |

FOREIGN PATENT DOCUMENTS

| | | | |
|---|---|---|---|
| 0025617 | 2/1977 | Japan | 72/60 |
| 0025618 | 2/1977 | Japan | 72/60 |

OTHER PUBLICATIONS

"E. C. Uberbacher", Superplastic Tools and Materials, Apr. 1969, vol. II, No. 11, p. 1414.

*Primary Examiner*—David Jones

*Attorney, Agent, or Firm*—Lawrence N. Ginsberg; Charles T. Silberberg

[57] ABSTRACT

A method and apparatus for the superplastic forming of a workpiece are disclosed. The invention comprises securing the workpiece within a die assembly located within an autoclave. The die assembly is of a type suitable for use in the superplastic fabrication of workpieces. The die assembly includes a lid, a die and first and second sealing mechanisms. The first sealing mechanism seals a first volume formed between the lid and the workpiece from a main volume of the autoclave. The second sealing mechanism is for sealing a second volume formed between the workpiece and the die from the main volume of the autoclave. The second volume has a backpressure, $P_b$. The first volume has a pressure $P_f+P_b$ where $P_f$ is the forming pressure for achieving superplastic forming of the workpiece. The main volume of the autoclave has a pressure, $P_m$. The back pressure, $P_b$ is established so as to minimize grain boundary cavitation. A minimal pressure differential $\Delta P=P_m-P_b$, is established which allows retention of the required sealing, while concomitantly providing $P_f$ for the desired superplastic forming of the workpiece and eliminating the need to seal against $P_b$.

4 Claims, 1 Drawing Sheet

APPARATUS AND METHOD FOR SUPERPLASTIC FORMING

BACKGROUND OF THE INVENTION

1. Field of the Invention

The present invention relates to superplastic forming processes and more particularly to an apparatus and method for superplastic forming using an autoclave.

2. Description of the Related Art

It is well known that under the proper conditions certain materials exhibit superplasticity. Superplasticity is the capability of a material to develop unusually high tensile elongations with reduced tendency toward necking, a capability exhibited by only a few metals and alloys and within a limited temperature and strain rate range. Titanium, aluminum, and alloys therefrom are generally the materials chosen when superplastic forming techniques are implemented because these materials exhibit superplastic characteristics equal to or greater than those of any other metals. With suitable titanium alloys, overall increase in surface area of up to 300% are possible.

The advantages of superplastic forming are numerous. For example, very complex shapes and deep drawn parts can be readily formed. Low deformation stresses are required to form the metal at the superplastic temperature range, thereby permitting forming of parts under low pressures which minimize tool deformation and wear. This process allows the use of inexpensive tooling materials, and eliminates creep in the tool. Single male or female tools can be used. No spring-back occurs or Bauschinger effect develops. Multiple parts of different geometry can be made during a single operation and very small radii can be Formed. An example of a method used for the superplastic forming of metals is disclosed in U.S. Pat. No. 3,934,441, issued to Hamilton et al, entitled "Controlled Environment Superplastic Forming of Metals," assigned to the present assignee.

Currently, most superplastic forming techniques utilize an assembly having an upper press platen and a lower platen. Adjacent the lower surface of the upper press platen is a lid. A die is located adjacent the upper surface of the lower platen. The metal sheet to be superplastically formed is maintained between the lid and the die. The lid contains an inlet for providing pressurized gas to the upper side of the metal sheet at the necessary pressure for superplastic forming. The die contains an access for supplying gas to or removing gas from the die cavity. Seals are maintained between the lid and the metal sheet and between the metal sheet and the die. Typically, a hydraulic ram is used to properly seat the seals. Frequently, a desired pressure, i.e. back pressure that may be several times higher than the forming pressure, is maintained in the die cavity to minimize grain boundary cavitation. Application of such back pressure necessitates that pressures for superplastic formation be concomitantly increased. The resulting high pressures severely jeopardize the integrity of the seals.

U.S. Pat. No. 4,288,021, issued to W. Leodolter, entitled "Tooling for Superplastic Forming Diffusion Bonding Processes" discloses a tooling for use in an autoclave or a hot press for the superplastic forming and diffusion bonding of metals. The tooling includes upper and lower portions with a labyrinth seal therebetween having inert counterflowing gas introduced thereto to prevent contamination from flowing across the seal to attack the metal being processed. The labyrinth seal consists of sealing tubes defining two passages to be vented to remove gas and thereby prevent part contamination by the carbon dioxide gas used to pressurize the autoclave. The autoclave carbon dioxide pressure is used to effect potentially leaky tubing seals and the titanium spacing ring seal. No provision is made in the '021 device for the use of back pressure. Thus, there are potential grain boundary cavitation problems. Further, if the use of back pressure were attempted, the seals would have to act against the back pressure plus the forming pressure inasmuch as at least one of spaces of the labyrinth seals is vented to the atmosphere.

OBJECTS OF THE INVENTION

It is, therefore, a principle object of the present invention to provide for efficient, economic superplastic forming of workpieces.

It is another object of the present invention to improve seal reliability which is compatible with the high temperatures and pressures involved in a superplastic forming process.

It is yet another object of the present invention to eliminate the requirement of platens.

It is still another object of the present invention to provide a superplastic forming process in which back pressure is limited only by the constraints of an autoclave.

It is yet another object of the present invention to eliminate the need to seal against a back pressure.

It is still another object of the present invention to provide a superplastic forming method in which the die is simplified and less expensive than currently used superplastic forming processes.

SUMMARY OF THE INVENTION

These and other objects are achieved by the present invention which is a method and apparatus for the superplastic forming of a workpiece.

In its broadest aspects, the invention comprises securing the workpiece within a die assembly located within an autoclave. The die assembly is of a type suitable for use in the superplastic fabrication of workpieces. The die assembly includes a lid, a die and first and second sealing means. The first sealing means seals a first volume formed between the lid and the workpiece from a main volume of the autoclave.

The second sealing means is for sealing a second volume formed between the workpiece and the die from the main volume of the autoclave. The second volume has a back pressure, $P_b$. The first volume has a pressure $P_f+P_b$ where $P_f$ is the forming pressure for achieving superplastic forming of the workpiece. The main volume of the autoclave has a pressure, $P_m$. The back pressure, $P_b$ is established so as to minimize grain boundary cavitation. A minimal pressure differential $\Delta P=P_m-P_b$, is established which allows retention of the required sealing, while concomitantly providing $P_f$ for the desired superplastic forming of the workpiece and eliminating the need to seal against $P_b$.

By conducting the process in an autoclave where the "ambient" pressure is set to be equal to the sum of the required backpressure, the forming pressure and the sealing pressure, the pressure differential to be sealed against is reduced. The sum of the sealing pressure plus the forming pressure constitutes the entire differential pressure that must be sealed against. This is in contrast to current practices in which the differential pressure to be sealed against is the sum of the back pressure and the forming pressure.

Other objects, advantages and novel features of the present invention will become apparent from the following detail description of the invention when considered in conjunction with the accompanying drawings.

BRIEF DESCRIPTION OF THE DRAWINGS

The same elements or parts throughout the figures are designated by the same reference characters.

DETAILED DESCRIPTION OF THE PREFERRED EMBODIMENTS

Figure 1:
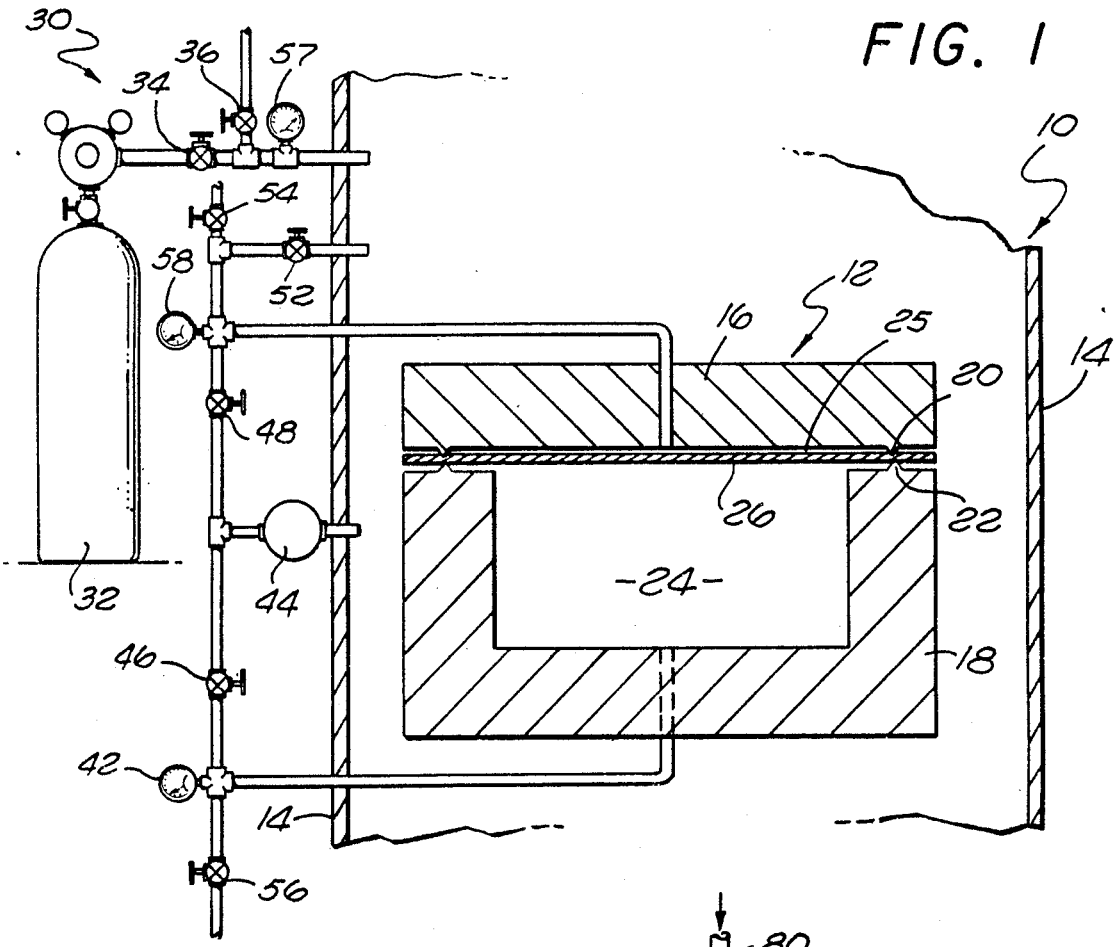
FIG. 1 is a schematic illustration of the apparatus of the present invention implemented with a gas pressure actuated seal.

Referring to the drawings and the characters of reference marked thereon, FIG. 1 illustrates a preferred embodiment of the present invention, designated generally as 10, in which a gas pressure actuated seal is utilized.

A die assembly, designated generally as 12, is located within an autoclave 14 of a type suitable for the superplastic fabrication of workpieces. Although, in the schematic illustrated, only two vertical walls are shown, it is assumed that the die assembly is within the autoclave 14 confines. Futhermore, although not specifically illustrated, it is assumed that conventional provisions are provided within the autoclave 14 for heating the die assembly 12.

The die assembly 12 includes, as essential components, a lid 16, a die 18, first sealing means 20, and second sealing means 22. The die 18 contains a die cavity 24 which may contain a conventional die insert (not shown) for additional abilities in contouring the workpiece 26. The first sealing means 20 is for sealing a first volume 25 from between the lid 16 and the workpiece 26 from the main volume of the autoclave. The second sealing means 22 is for sealing a second volume (i.e. die cavity 24) disposed between the workpiece 26 and the die 18 from the main volume of the autoclave 14.

The first sealing means may include, for example, a raised metal bead 22 extending from the periphery of the lid 16 toward the surface along the periphery of the workpiece 26. Similarly, the second sealing means may include a raised metal bead 20 extending along the periphery of top surface of the die 16 and extending toward the bottom of the workpiece 26. Both metal beads 20, 22 are shaped to bite into their respective adjacent surface of the workpiece 26.

During use, as will be explained below, the second volume 24 is maintained with a back pressure, $P_b$. The first volume 25 is maintained with a pressure, $P_f+P_b$. where $P_f$ is the forming pressure for achieving superplastic forming of the workpiece. The main volume of the autoclave 14 has a pressure of $P_m$.

A gas supply system, designated generally as 30, is provided for establishing the desired gas properties. A high pressure inert gas source 32 provides gas through valve 34 to the autoclave 14. A vent valve 36 is provided for reducing the autoclave pressure.

Pressure gauge 42 measures die cavity pressure. A differential pressure regulator 44 is provided to maintain the desired sealing pressure $P_s$, which is equal to $P_m-P_b-P_f$. Shut-off valve 52 is provided to the autoclave 14. Vent valves 54, 56 are provided for venting gas from spaces 25 and 24, respectively. Gauge 58 measures the forming cavity pressure.

The following steps describe the operation of the present invention:

1. During startup, all valves are closed.
2. The autoclave 14 is then pressurized through valve 34 with valves 54 and 56 open until a pressure, $P_s$, is reached (as indicated by gauge 57) to seat seals 22 and 20, whereby spaces 24 and 25 are isolated from the main autoclave space. (Although not shown in the embodiment of FIG. 1, a mechanical means such as shown in the FIG. 2 embodiment, may be employed to assist in the initial venting of the seals.)
3. The differential pressure regulator 44 is then set to maintain a pressure differential of $P_s$ (as determined in the previous step) between its inlet (from the main autoclave space) and its outlet.
4. Valves 54 and 56 are then closed and valves 46 and 48 are opened and pressurization of the autoclave 14 is resumed through valve 34. This is continued until pressure gauges 42 and 58 show that spaces 25 and 24 are at a pressure level equal to $P_b+P_{f(max)}$ where; $P_b$ is the desired back pressure and $P_{f(max)}$ is the maximum superplastic forming pressure as determined from the pre-calculated pressure time profile. The gas source regulator from source 32 is then set to maintain autoclave pressure at the sum of $P_b$, $P_{f(max)}$, and $P_s$, and valve 46 is closed.
5. Gas is then bled off from space 24 through valve 56 to the degree required to establish an increase in forming pressure, $P_f$, across the workpiece 26. When necessary to decrease forming pressure across the workpiece 26, valve 56 is then closed and gas introduced into the space 24 through valve 46.

As an alternate to closing valves 54 and 56 and opening valves 46 and 48 and then resuming pressurizing the autoclave through valve 34, step 4 could be modified to continue pressurization of the autoclave until spaces 25 and 24 are at a pressure equal to the desired back pressure, $P_b$. At this point, valves 46 and 48 are closed and the autoclave is further pressurized to a level equal to $P_b+P_{f(max)}+P_s$ to which the regulator connected to source 32 is then set. Step 5 is then modified to establish superplastic forming pressure by introducing gas into space 25 through valve 48. When necessary to decrease the forming pressure, valve 48 is closed and valve 54 is opened to bleed off gas from space 25.

By using the above processes, a sufficient $P_b$ is established so as to minimize grain boundary cavitation. A minimal pressure differential, $\Delta P=P_m-P_b$, which is required to be sealed against, is maintained. While at the same time, the need to seal against back pressure, $P_b$ is eliminated.

Figure 2:
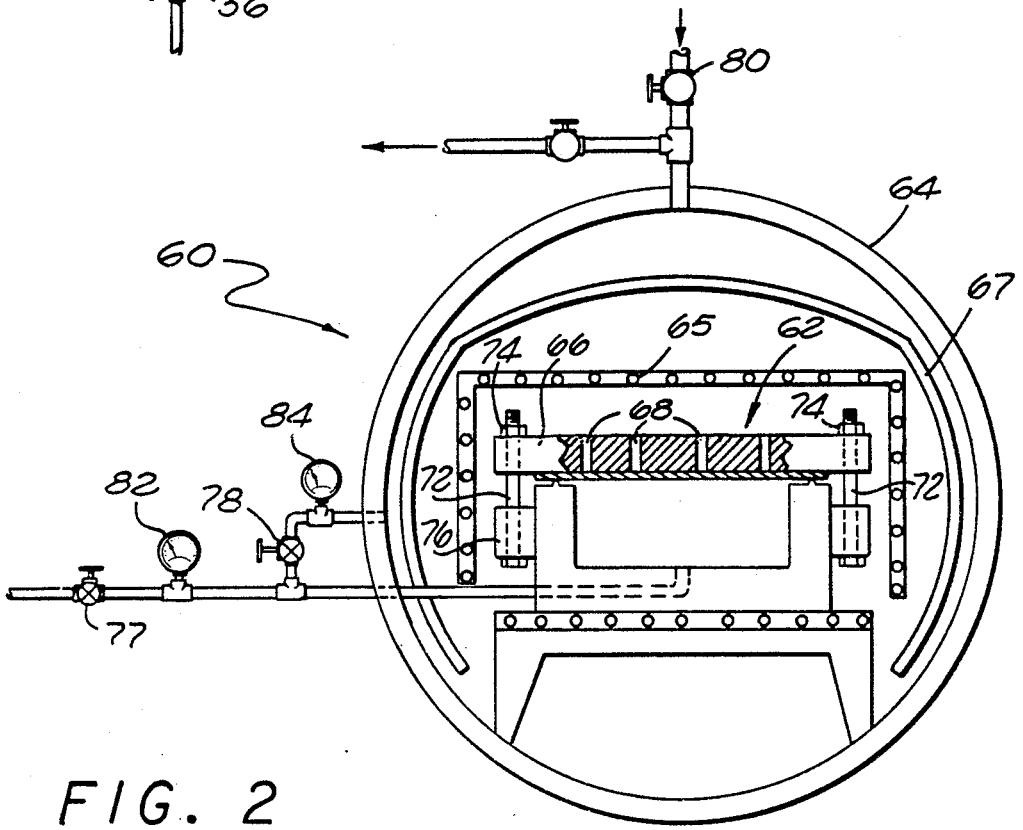
FIG. 2 is a schematic illustration of the present invention implemented with a mechanically actuated seal.

Referring now to FIG. 2, a second embodiment of the apparatus of the present invention is shown, illustrated generally as 60. A die assembly, designated generally as 62, is secured within an autoclave 64. In the embodiment illustrated, heaters 65 as well as reflectors 67 are illustrated. (The autoclave walls might be water-cooled to prevent overheating.)

The die assembly 62 includes a lid 66 with openings 68 to provide fluid communication between the autoclave main pressure, $P_m$, and the workpiece 70.

A mechanical force application means, for example, a mechanical fastener 72, including nuts 74, acting through bosses 76 on the periphery of the die walls, is used for forcing the lid 66 against the workpiece 70 to effect the desired seal between the workpiece 70 and the die 66.

In operation, the autoclave 64 is pressurized by closing vent valve 77, opening valve 78 and pressurizing the autoclave 64 through inlet valve 80. The user must be careful to proceed at a rate of pressurization such that gauges 82, 84 read alike. The die cavity and the autoclave 66 are pressurized to and maintained at a level of pressure equal to the sum of the desired back pressure plus the maximum forming pressure to be applied.

Valve 78 is closed. Gas is then bled off by means of valve 77 to establish the predetermined pressure-temperature forming profile. If it is necessary to decrease the forming pressure, then valve 77 is closed and valve 78 is opened to add gas to the die cavity, as necessary.

Obviously, many modifications and variations of the present inventions are possible in light of the above teachings. It is, therefore, to be understood that within the scope of the appended claims the invention may be practiced otherwise than as specifically described.

What is claimed and desired to be secured by the Letters Patent of the United States is:

1. A method of superplastic forming a workpiece, comprising the steps of:

(a) securing the workpiece within a die assembly located within an autoclave, said die assembly being of a type suitable for use in the superplastic fabrication of workpieces, said die assembly including a lid, a die having a die cavity, and sealing means for effecting a seal between the die cavity and the workpiece, said sealing means including mechanical force application means for forcing the lid against the workpiece to effect the desired seal between the workpiece and the die, (b) establishing a sufficient die cavity back pressure, $P_b$, so as to minimize grain boundary cavitation; and (c) establishing a minimal pressure differential, $\Delta P = P_m - P_b$, where $P_m =$ the pressure in the main volume of the autoclave, which allows retention of the required sealing while concomitantly providing sufficient forming pressure, $P_f$, for the desired superplastic forming of the workpiece.

2. The method of claim 1 wherein said seal is effected by applying mechanical force application means, which includes threaded fasteners acting through holes in the lid and opposing holes in bosses on the outer periphery of the die walls, said fasteners being applied so as to provide an equal distribution of force.

3. The method of claim 1 wherein said forming pressure, $P_f$, is established by a differential between the autoclave and the die cavity pressures.

4. An apparatus for superplastic forming a workpiece, comprising:

(a) an autoclave;

(b) a die assembly located within said autoclave, said die assembly being of a type suitable for use in the superplastic fabrication of workpieces, said die assembly including a lid, a die having a die cavity, and means for effecting a seal between the die cavity and the workpiece, said means for effecting a seal including mechanical force application means for forcing the lid against the workpiece to effect the desired seal between the workpiece and the die;

(c) means for establishing a sufficient die cavity back pressure. $P_b$, so as to minimize grain boundary cavitation; and (c) means for establishing a minimal pressure differential, $P_m - P_b$, where $P_m$ equals the pressure in the main volume of the autoclave, which allows retention of the required sealing, while concomitantly providing sufficient forming pressure, $P_f$, for the desired superplastic forming of the workpiece.

* * * * *